United States Patent [19]

Pipkin et al.

[11] 3,943,874

[45] Mar. 16, 1976

[54] RIVER MINE COUNTERMEASURE DEVICE

[75] Inventors: Edward L. Pipkin; William H. Tolbert, both of Panama City, Fla.

[73] Assignee: The United States of America as represented by the Secretary of the Navy, Washington, D.C.

[22] Filed: Oct. 16, 1967

[21] Appl. No.: 676,384

[52] U.S. Cl. ..... 114/221 A

[51] Int. Cl.[2] ..... B64B 9/00

[58] Field of Search ..... 114/221, 221.1, 235, 235.2; 89/1.01, 1 A, 1 M

[56] References Cited

UNITED STATES PATENTS 3,326,173 6/1967 Kurtz ..... 114/221 A 3,850,075 11/1974 Temple ..... 114/221 A

*Primary Examiner*—Verlin R. Pendegrass

*Attorney, Agent, or Firm*—Richard S. Sciascia; Louis A. Miller; Don D. Doty

[57] ABSTRACT

A free-running river mine disabler having a float which is propelled under the river surface by means of the river current. A wire cutter is towed along the river bottom by said float in such manner as to sever the ignition wires of electrically detonated mines.

12 Claims, 5 Drawing Figures

Edward L. Pipkin
William H. Tolbert
INVENTORS

BY

Dox D. Doty
Attorney

Edward L. Pipkin
William H. Tolbert
INVENTORS

BY

Dorc D. Doty
Attorney

RIVER MINE COUNTERMEASURE DEVICE

The present invention relates generally to wire cutters and, in particular, is a device for cutting the ignition wires of river mines, in order to effectively sweep and thereby prevent subsequent detonation thereof.

In the past, numerous devices have been employed for the cutting of marine mine ignition control wires, and, in many instances, they have been fairly satisfactory. However, for the most part, they have either been too specialized, or they otherwise leave a great deal to be desired, as far as results are concerned. For example, grapnels and chain drags, pulled by surface boats or other tractor means, are used to sever the ignition control wires that extend along the river bottoms between a watersubmerged marine mine and the human shore operator. Unfortunately, however, such devices are limited in their use, since they do not exactly follow the path of the boat when being towed around sharp river bends and, thus, they do not sweep some of the most critical areas. Furthermore, an enemy who is aware of such sweeping operations can usually repair cut wires, thereby making it necessary to conduct cutting operations immediately prior to the passage of the ships or vessels being protected. Moreover, men and crafts may be exposed to enemy fire during sweeping operations, which, obviously, is an undesirable situation.

The mine sweeping device constituting this invention overcomes most of the disadvantages of the prior art devices, including those mentioned above, inasmuch as it will sweep the entire channel of the river, including the sharp bends thereof, without requiring a tow-boat or manual or other guidance controls. Furthermore, the sweeping operations are done surreptitiously, which makes the enemy unaware that his mine has been made inoperative until he attempts to detonate it. Also, men and crafts are not exposed to dangerous enemy fire during sweeping operations. Moreover, once placed in the area to be swept, the device will sweep continuously and will change directions with each tidal reversal, if such exists. And, in addition, being cheap and simple, it requires no special skills or handling, and may be used economically in large numbers.

It is, therefore, an object of this invention to provide an improved river mine sweeper.

Another object of this invention is to provide a free-running, unguided, mine sweeper that will sever electrically detonated marine mine ignition wires which are laying on or buried in a river bottom.

Still another object of this invention is to provide a method and means for surreptitiously cutting electrical conductors laying on or buried in a river bottom, sea floor, or the like.

A further object of this invention is to provide a freefloating, current-driven mine countermeasure vehicle.

Another object of this invention is to provide an improved method and means for cutting electrical conductors and cables laying on or buried in the floor of a body of water having a current which does not require a tractor vehicle towing means to be combined therewith to provide the motive power therefor.

Another object of this invention is to provide a marine mine wire cutting means that is easily and economically manufactured, maintained, handled, stored, and operated.

Another object of this invention is to provide an improved Riverine mine countermeasure.

Other objects and many of the attendant advantages will be readily appreciated as the subject invention becomes better understood by reference to the following detailed description, when considered in conjunction with the accompanying drawings wherein.

Figure 1:
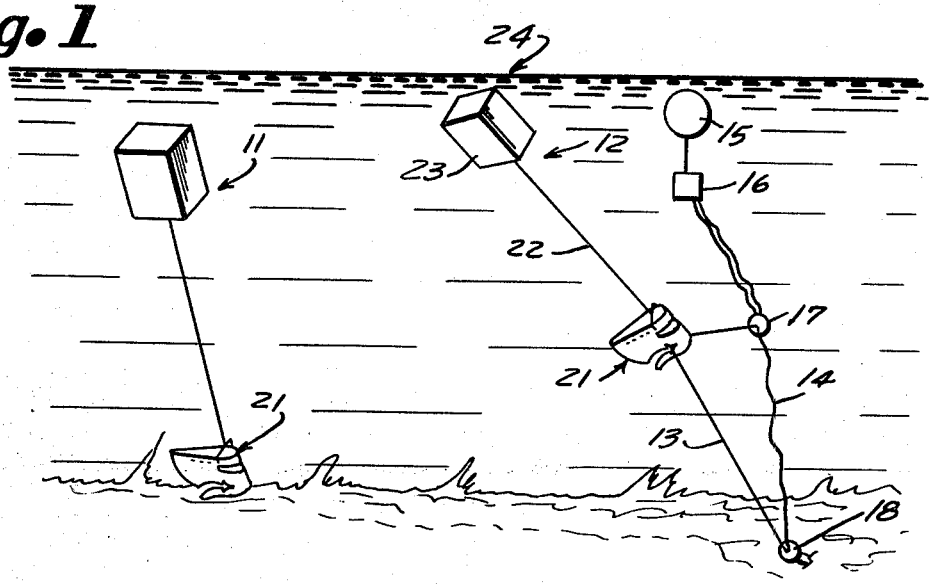
FIG. 1 is a quasi-pictorial view of the operations of the subject invention in a river environment.

Referring now to FIG. 1, there is shown a pair of the subject mine countermeasure devices 11 and 12, the former of which is running free and the latter of which has snagged wire 13 of the electrical ignition wires 13 and 14 of a marine mine 15. For the purpose of simplicity of disclosure, only two countermeasure devices have been disclosed herewith and only one thereof will be discussed in detail; however, it should be understood that as few or as many thereof may be used simultaneously or consecutively as is needed to provide the desired mine sweeping operations.

As depicted in FIG. 1, mine 15 is submerged within the river water and is held in place by a suitable anchor or weight 16. Weights 17 and 18 are usually also used to hold the ignition wires down on the river bottom which, of course, makes them difficult to acquire by most wire cutting means. The other ends of wires 13 and 14 usually extend upon the river bank to a camouflaged fire box or the like (not shown).

The preferred embodiment of the invention herewith disclosed contains a cutter assembly 21 which is connected by means of a flexible cable 22 to a styrofoam float 23. Although in this particular instance the aforesaid connecting means is defined as a flexible cable, a rigid rod or the like may be substituted therefor, if for any particular operational circumstance it is desirable to do so.

Float 23 preferably rides under the surface of river water 24, and in this particular view, it is being pulled to the left, as a result of the river current. Consequently, cutter assembly 21 is dragged along behind float 23 and along the river bottom in such manner that it will plow therein and, thus, snag any mine ignition wires laying thereon or buried therein.

Figure 2:
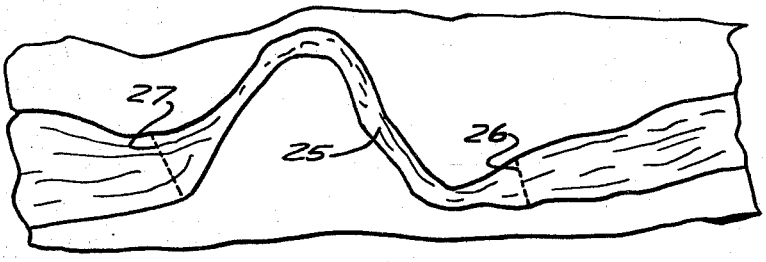
FIG. 2 is a pictorial top view of a river having several bends and subaqueous "fences" extending thereacross at various locations, so as to retain the subject invention within the confines thereof during current reverses.

As previously suggested, a river 25 is illustrated in FIG. 2. This river is herewith illustrated to show the types of bends that it may contain and still not adversely affect the operation of the subject invention disposed therein.

In addition, an upstream fence 26 and a downstream fence 27 are shown, which are used to confine one or more of the mine sweepers disposed therebetween. Obviously, in the event the river current changes direction due to a change of tidal conditions, then fence 26 will become the downstream fence and fence 27 will become the upstream fence.

Fences 26 and 27 are of any suitable types and are preferably submerged in the river water in such manner that they will not be readily sighted by an enemy or disrupt navigation on the river. Accordingly, their respective heights and dispositions may be whatever the circumstances demand. A typical representation of fences 26 and 27 are cables that are too large to be snagged by cutter 21 but large enough to restrain the entire countermeasure device.

Figure 4:
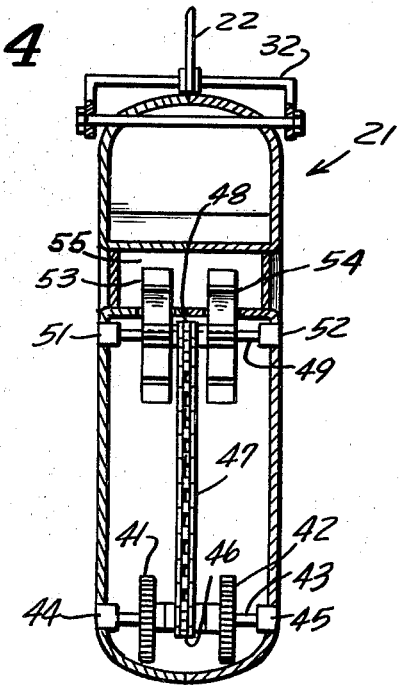
FIG. 4 is a cross-sectional view taken at 4—4 of FIG. 3.
Figure 3:
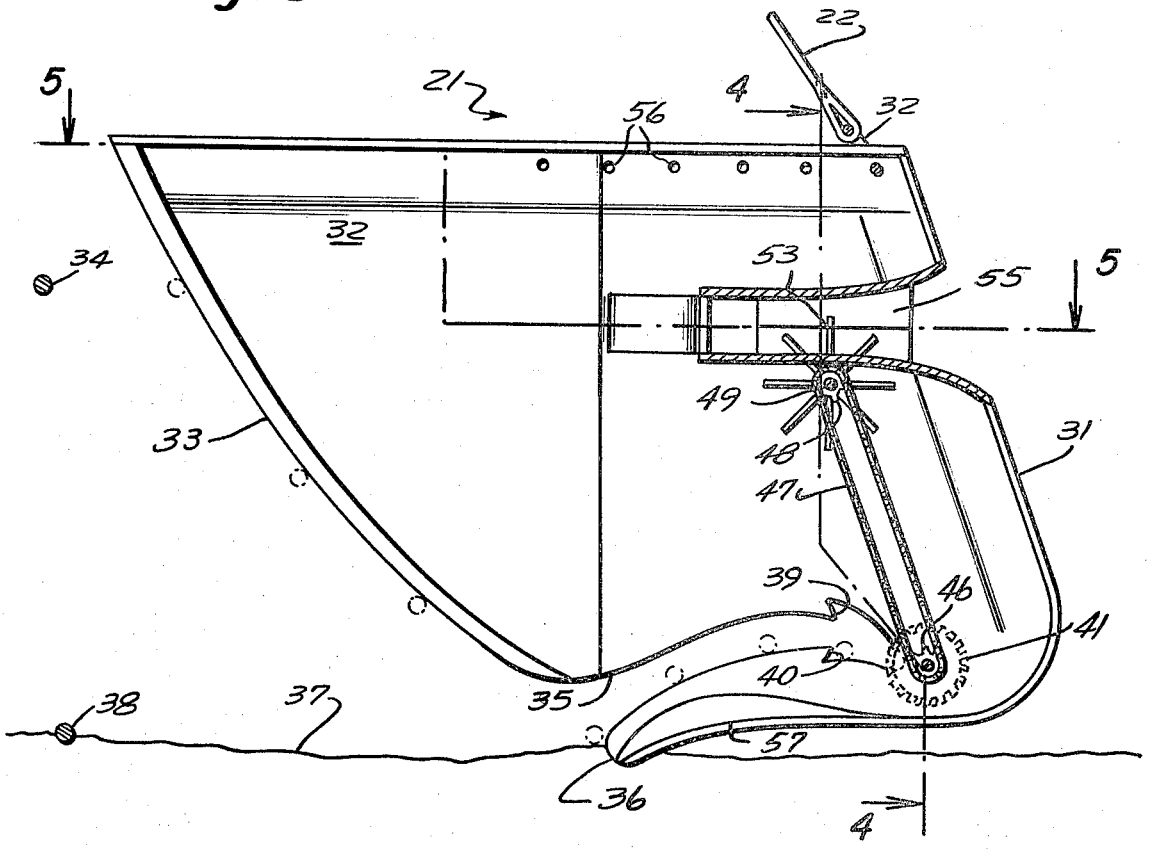
FIG. 3 is a schematic elevational view, with parts broken away, of the cutter portion of the invention.
Figure 5:
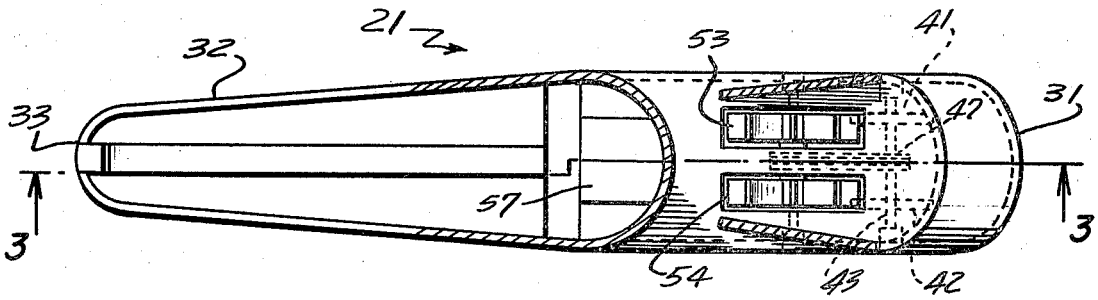
FIG. 5 is a top view taken along 5—5 of FIG. 3.

Referring now to FIGS. 3 and 4, cutter assembly 21 is shown in schematic structural detail and cross-section, respectively, as preferably having a two piece weighted body connected together as by welding or the like to form a housing 31 of substantially streamlined configuration, the streamlining thereof being of such design as to facilitate the movement of the entire cutter assembly from right to left (as shown in FIG. 3) through the water, as it is towed by its current driven float. The front portion of said cutter assembly contains a stabilizing fin 32, the front profile 33 of which is curved downwardly and rearwardly in such manner as to guide an electrical conductor 34 down into a lower mouth 35. The lower portion of mouth 35 is composed of a plow blade 36, which is intended to dig through the river bottom 37 at some predetermined depth, in order to snare any wires 38 that may be buried therein.

The rear of throat end of mouth 35 contains a pair of hooked sections, barbs or hooks 39 and 40, which tend to hold any snared wire within the confines thereof, thereby preventing it from working its way back out of said mouth. As may readily be seen, the throat profile is of such curvature as to guide the snared wire into circular cutting wheels or saws 41 and 42 which are mounted on a shaft 43 for rotation in any suitable bearings 44 and 45. Of course, bearings 44 and 45 are appropriately disposed in body 31 in any convenient manner for rigid support thereby.

Attached to shaft 43 is a driven sprocket gear 46, which is connected by means of a drive chain 47 to a drive sprocket gear 48 which, in turn, is rigidly attached to shaft 49. Shaft 49 is disposed for rotation in suitable bearings 51 and 52, which are, likewise, mounted securely in cutter body 31. Attached to shaft 49 are paddle wheels 53 and 54. Substantially all of the upper halfs of paddle wheels 53 and 54 are located within a water venturi or passageway 55 for movement by the river water flowing therethrough.

Cutter assembly 21 is, as previously mentioned, dragged along the river bottom by a tow cable or tow bar 22 which has the other end thereof connected to the float. Holes 56 provide tow cable 22 with connections points that may be used for making adjustments to provide substantially level "flight" of the entire cutting assembly for practically any river current velocity an river water and river bottom conditions.

As previously suggested, cutter 21 may be weighted in any convenient manner which will cause it to drag along the river bottoms and, to a certain extent, plow therein. For this purpose, a predetermined weight may be attached thereto as an integral part thereof. For example, plow 36 may include such a weight 57, although it should be understood that such weight may also be located at any other position on the cutter assembly which will provide stability and balance for any given operational circumstances.

The paddle wheel-circular saw drive mechanism mentioned above should be considered as being exemplary drive means only; hence, if so desired, a train of drive gears may be substituted for the drive and driven sprockets and the chain therebetween, inasmuch as so doing would merely be a matter of design choice, the making of which would be well within the purview of one skilled in the art having the benefit of the teachings herewith presented.

The operation of the subject invention will now be discussed briefly in conjunction with all of the drawing figures.

Because the entire device is easily handled, it may be dropped overboard into the river to be swept from a small boat, aircraft, or the like, as convenient during any given operation or tactical situation. Furthermore, any number thereof may be used for sweeping the electrical ignition wires of electrically detonated marine mines which may be laying on or buried in the river bottom. Of course, the more sweepers that are employed, the greater the probabilities that all of said wires are severed and, thus, the greater the probabilities that ships or the like can navigate the river with safety.

Because float 23 acts as the device that is responsive to the water power of the river current, it must be properly shaped and large enough to pull the cutter assembly along the river bottom. However, it should preferably not be so large as to be visible while in operation. In order to operate in a clandestine manner, the entire mine countermeasure device should remain under water at all times. This means that float 23, though buoyant, remains submerged at all times, and the length of tow cable 22 must be selected according to the depth of the river being swept and the attitude at which it is desired that cutter assembly 21 maintain while it is plowing along the river bottom. If necessary, the float may be camouflaged to prevent its being sighted by an enemy observing the river.

Once the subject minesweeper has been disposed in the water, it is powered by the river current. Because the entire device is properly weight balanced, and because it includes fin 32 which acts as a stabilizing and guidance means therefor, its general direction of travel is usually parallel to that of the river current and its attitude while traveling is such that leading edge 33, mouth 35, and plow 36 are in positions which facilitate the acquiring of any mine control wire contacted thereby.

Because the rivers in which this invention may be used may have tidal currents, the direction of water flow reverses therewith. Such reverses, of course, causes the subject mine sweeper to sweep back and forth in the river. However, in the event the sweeping operations are to be restricted in area, as shown in FIG. 2, underwater fences, which may, for example, actually be cables that are too large in diameter to enter the mouth of cutter 21, may be erected in such manner as to confine them thereto. As previously indicated, the fact that a particular river has many bends does not adversely affect the effectiveness of the invention. As long as there is sufficient current to carry it along, mine sweeping occurs.

Once a wire has been snared by mouth 35 of cutter 21, further movement of said cutter causes it to be moved back into contact with a circular cutting wheel, knife, or saw 41. At that time, one or both of two things occur that cause the snared wire to be severed. As a result of the wire being snared, the cutter begins to wobble, and the wobbling action of the cutter may cause the cutting of the wire as it is impacted numerous times against the cutting saw. Or, due to the rotation of the circular saw, the wire may be cut in two.

Rotation of circular saw 41 is effected by means of paddle wheel 53 being driven by the water flow through passageway 55, which in turn, through sprocket 48, chain 47, and sprocket 46, drives said saw 41. Obviously, movement of the saw teeth against the wire saws it in two.

In order to increase the probability of cutting a snared wire, or in order to expedite the cutting thereof, float 23 may be so shaped as to increase the wobbling action thereof and thus, increase the wobbling action of the entire cutter as well.

Although, as previously mentioned, the leading edge 33 of stabilizing fin 32 is curved downwardly and rearwardly in such manner as to guide an electrical conductor 34 down into its lower mouth 35, it should also be designed so that the invention will not become snagged or fouled on logs or any other relatively large debris of the type usually found on river bottoms.

Instead of the aforementioned water current powered cutting saw, other cutter and power variations may be employed, if so desired. For instance, a cutter wheel may be powered by explosives, chemicals, batteries, or springs.

Furthermore, the subject mine countermeasure device may be modified to incorporate various acoustical markers which are launched or enabled upon the contact with an electrical conductor, thereby providing information to one navigating the river that an electrically controlled mine exists in that area. Further modification could also include bottom followers equipped with other types of sensors, such as metal detectors or the like, and means to mark, neutralize, or destroy a submarine mine.

Obviously, other embodiments and modifications of the subject invention will readily come to the mind of one skilled in the art having the benefit of the teachings presented in the foregoing description and the drawings. It is, therefore, to be understood that this invention is not to be limited thereto and that said modifications and embodiments are intended to be included within the scope of the appended claims.

What is claimed is:

1. Means for acquiring and cutting marine mine control wires laying on and buried in the bottom of a river:

a housing means;

passageway means of predetermined geometrical configuration located in said housing means for the controlled flow of river water therethrough;

cutting means mounted for rotation in said housing;

means mounted in said housing and extending within said passageway means for rotation therein in response to river water flowing therethrough;

means interconnecting said water responsive rotating means and the aforesaid cutting means for the driving thereof thereby;

means connected to said housing means for guiding the marine mine control wires to be cut into engagement with the aforesaid cutting means upon contact therewith; and means connected to the aforesaid housing means for the propulsion thereof in such manner within said river that wires laying on and buried in the bottom thereof will be contacted, acquired, and guided for engagement with said cutting means by the aforesaid wire guiding means.

2. The device of claim 1 wherein said cutting means mounted for rotation in said housing comprises a circular saw.

3. The device of claim 1 wherein said cutting means mounted for rotation in said housing comprises a circular knife.

4. The device of claim 1 wherein said means mounted in said housing and extending within said passageway means for rotation therein in response to river water flowing therethrough comprises a paddle wheel.

5. The device of claim 1 wherein said means interconnecting said water responsive rotating means and the aforesaid cutting means for the driving thereof thereby comprises:

a first sprocket rigidly attached to said water responsive rotating means for rotation therewith;

a second sprocket rigidly attached to said cutting means for rotation therewith; and a drive chain connected between said first and second sprockets.

6. The invention of claim 1 further characterized by weight means effectively connected to said marine mine control wire guiding means for appropriately balancing, stabilizing, and downwardly pulling the entire marine mine control wire acquiring and cutting means.

7. The invention according to claim 1 wherein said means connected to said housing means for guiding the marine mine control wires to be cut into engagement with the aforesaid cutting means upon contact therewith comprises:

a stabilizing fin connected to said housing in such manner as to extend in the forward running direction therefrom, said stabilizing fin having a leading edge that slopes downwardly and rearwardly;

a mouth disposed in the lower end of said stabilizing fin, said mouth being a continuation of the aforesaid leading edge and having a rearward throat which extends past the cutting edge of the aforesaid cutting means;

a plow blade integrally attached to the lower forward edge of said stabilizing fin in such manner that it will plow through a predetermined depth of the aforesaid river bottom as said entire marine mine control wire cutting means is pulled through the water of said river.

8. The invention of claim 7 further characterized by a pair of barbs disposed in the throat end of said mouth in substantially contiguous relationship with the aforesaid cutting means for holding of acquired wires therein.

9. The device of claim 1 wherein said means connected to the aforesaid housing means for the propulsion thereof in such manner within said river that wires laying on or buried in the bottom thereof will be contacted, acquired, and guided for engagement with said cutting means by the aforesaid wire guiding means comprises:

a float having a predetermined buoyancy, size, and shape, which is responsive to a river current in such manner as to be carried along therewith while being submerged therein; and a flexible cable connected between said float and the aforesaid marine mine control wire guiding means.

10. The invention of claim 9 further characterized by means disposed between said marine mine control wire guiding means and the aforesaid flexible cable for adjusting the relative positions thereof.

11. The device of claim 1 wherein said means connected to the aforesaid housing means for the propulsion thereof in such manner within said river that wires laying on or buried in the bottom thereof will be contacted, acquired, and guided for engagement with said cutting means by the aforesaid wire guiding means comprises:

a float having a predetermined buoyancy, size, shape, which is responsive to a river current in such manner as to be carried along therewith while being submerged therein; and a rigid rod connected between said float and the aforesaid marine mine control wire guiding means.

12. The invention of claim 11 further characterized by means disposed between said marine mine control wire guiding means and the aforesaid rigid rod for adjusting the relative positions thereof.

* * * * *